US006130702A

United States Patent [19]

Ganton

[11] Patent Number: 6,130,702

[45] Date of Patent: Oct. 10, 2000

[54] METHOD FOR RELIABLE LOADING OF UNEXPOSED PRINTING PLATES

[75] Inventor: Robert B. Ganton, Coquitlam, Canada

[73] Assignee: Creo Products Inc., Burnaby, Canada

[21] Appl. No.: 08/508,565

[22] Filed: Jul. 28, 1995

[51] Int. Cl.[7] ..... B41J 2/47

[52] U.S. Cl. ..... 347/264; 347/262

[58] Field of Search ..... 347/262, 264

[56] References Cited

U.S. PATENT DOCUMENTS 4,404,481 9/1983 Ide et al. ..... 327/100
5,099,386 3/1992 Stokes et al. ..... 361/298.5
5,367,360 11/1994 McIlwraith ..... 355/85

*Primary Examiner*—Mark J. Reinhart

[57] ABSTRACT

In a computer-to-plate system, printing plates are loaded from their shipping container onto a drum, where they are exposed by a laser. As the plates are packed with paper sheets between them, a paper removal system followed by a capacitance probe is used. The capacitance probe detects any paper remaining on the front or back of the plate. The plate is gravity loaded onto the drum and is resting on two contact points identical in position to the contact points of plate punching equipment. The orthogonal edge of the plate is detected electronically, in order to fully register the image to the plate. Magnetic clamps hold the plate to the imaging drum.

14 Claims, 2 Drawing Sheets

METHOD FOR RELIABLE LOADING OF UNEXPOSED PRINTING PLATES

BACKGROUND OF THE INVENTION

The invention relates to the printing industry and more specifically to loading of unexposed printing plates onto an exposure device. Printing plates are usually shipped in cardboard containers with paper sheets, also known as slip sheets, separating the plates. The paper sheets sometimes adhere to the front or back of the plate, in particular when plates are sheared to size with the paper sheets in place. In a manual operation the operator has no difficulty seeing when a paper sheet adheres to the plate and has to be removed. In an automated system the reliable handling of the plates in the presence of slip sheets is a problem, as the automated system has difficulty detecting if a slip sheet is fully removed. The slip sheets come in many colors and textures, some hard to tell apart from the plate. As the plate manufactures can change the type and color of paper used as slip sheets at any time reliable detection based on color and/or surface texture is not possible. The consequences of an undetected slip sheet are serious, as the slip sheet can be passed on to the plate processor where it contaminates the processor.

After successful removal of slip sheet and verification that no paper remained attached to either front or back of plate, the plate is loaded onto the imaging unit for exposure. As the image has to be registered to the edge of the plate, the method used for edge detection is critical. When the imaging device is a drum type, reliable clamping means are required to accommodate many plate sizes on a single exposure device. Prior art plate handling equipment suffers from three main limitations:

A. Lack of reliable means to detect the absence of paper from both sides of the plates.

B. Lack of ability of handling a continuously range of plate sizes, due to need for fixed clamps.

C. The need to use special cassettes instead of loading directly from shipping boxes.

It is the object of this invention to overcome these limitations and reliably load printing plates onto an imaging device, thus increasing the degree of pre-press automation. A further object is to provide a flexible system capable of handling a continuously variable range of plate sizes and thicknesses.

BRIEF DESCRIPTION OF THE INVENTION

The invention consists of three main steps: separating the plates from the slip sheets, verifying that no paper adheres to the plates and loading the plates precisely on the imaging system (a drum in the preferred embodiment). The removal of the plates from the shipping box is not covered by the current invention as it is fully covered by co-owned U.S. Pat. No. 5,367,360, incorporated here as a reference. The slip sheet detector takes advantage of the fact that the plates are made of metal and are thus conductors while the slip sheets are insulators, thus the capacitance between an electrode and the plate will be affected by the slip sheet. A capacitance measuring device is connected to a sensing electrode in order to detect slip sheets adhering to the plate. The plates are loaded onto the imaging drum, registered by optical and/or mechanical means and clamped by a magnetic clamp. The magnetic clamp can be placed at any position along the circumference of the drum thus continually variable plate sizes can be accommodated. The invention will become more apparent by studying the following drawings in conjunction with the description of the preferred embodiment:

DESCRIPTION OF THE PREFERRED EMBODIMENT

Figure 1:
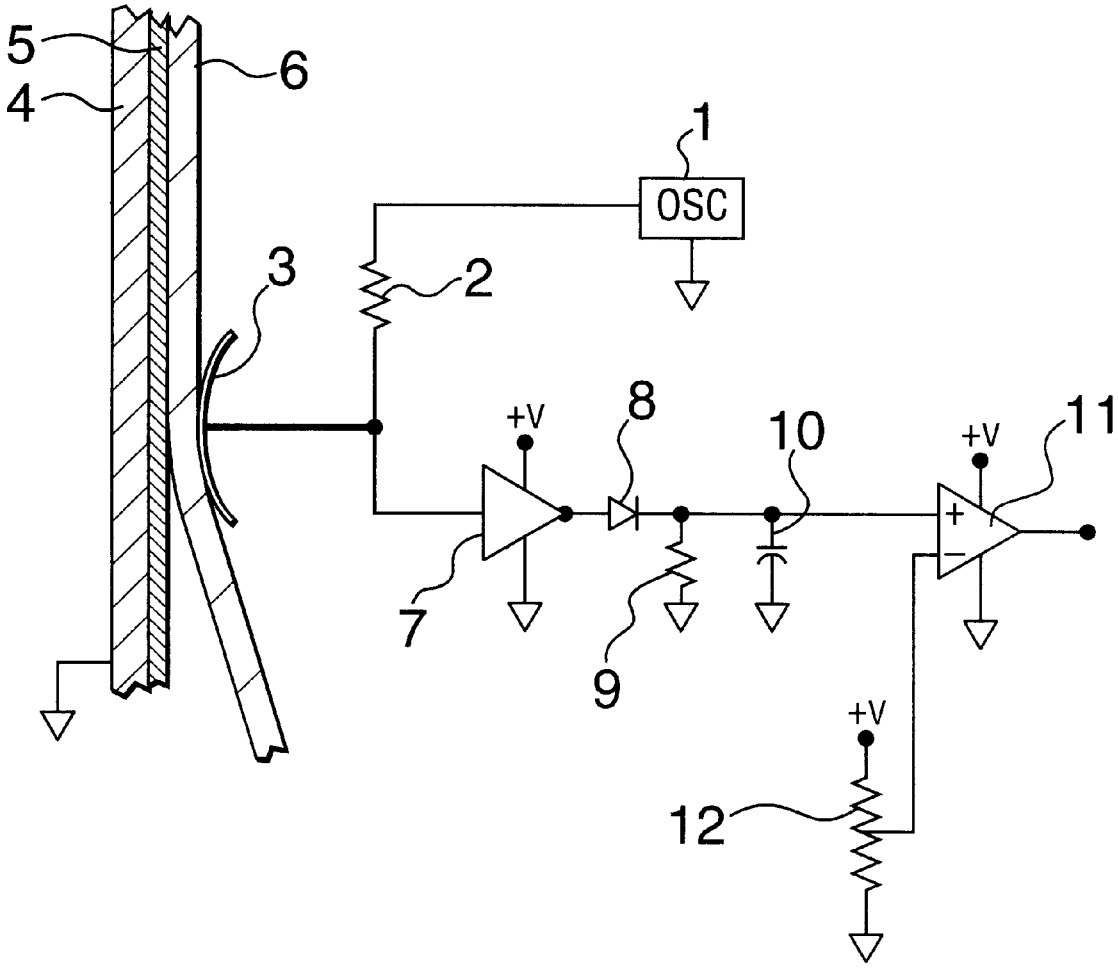
FIG. 1 is a schematic drawing of the slip sheet sensor.
Figure 2A:
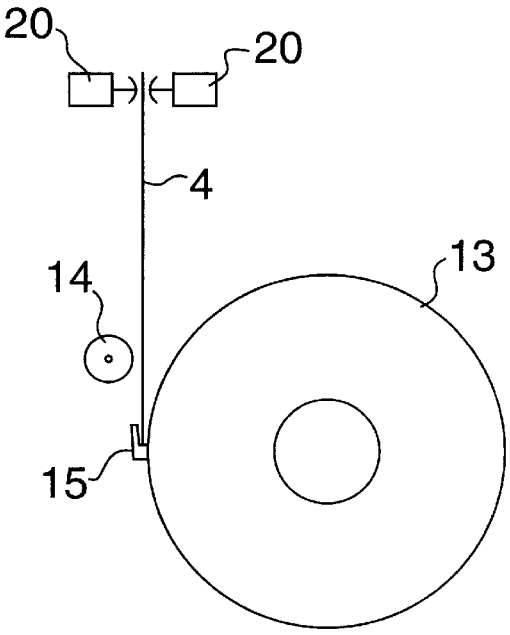
FIG. 2-*a* to FIG. 2-*d* shows the sequence of operations required to implement the invention.
Figure 2B:
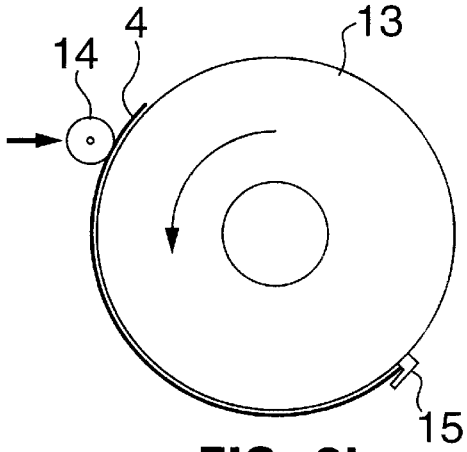
Figure 2C:
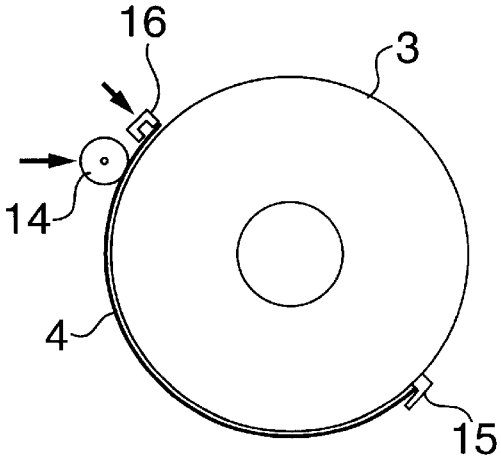
Figure 2D:
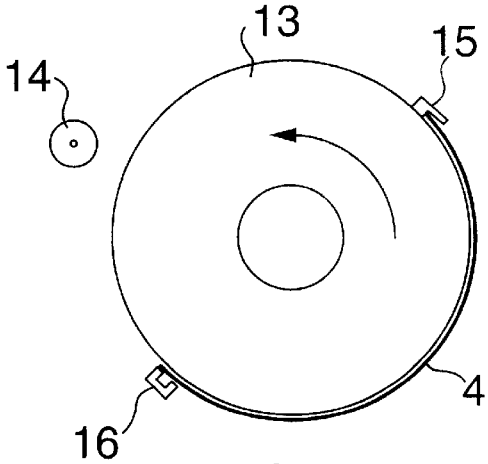

Referring now to FIG. 1 the principle of the slip sheet detector will be explained. A printing plate 4, typically made of aluminum, is coated with a polymer layer 5. The slip sheet 6, typically made of paper, is normally not attached to plate 4 when plate is picked up. Occasionally slip sheet 6 adheres to the plate 4 and could cause malfunction of the plate 4 exposure system if this condition is not detected. The detection circuit operates on the principle of a parallel plate capacitor. The capacitance of a parallel plate capacitor is given by the formula C=EoErA/d where Eo is the dielectric constant of vacuum, Er is the relative dielectric constant of the insulator, A is the area of the smaller of the two plates and d is the thickness of the insulator. Since the polymer layer 5 is much thinner than slip sheet 6 (by about a factor of 10) and the Er is about the same for layers 5 and 6, the capacitance between electrode 3 and plate 4 will decrease about tenfold when a slip sheet 6 is present. Any one of the well known capacitance measuring circuits can be used to detect this difference in capacitance. The circuit shown in FIG. 1 is shown by the way of example only. Oscillator 1, operating at a frequency of about 100 kHz is connected to electrode 3, made of metal and having an area of at least a few square centimeters, via resistor 2. The capacitor formed between electrode 3 and plate 4 forms a voltage divider with resistor 2. The voltage of this divider is amplified by amplifier 7, rectified by diode 8 and filtered by resistor 9 and capacitor 10. The time constant of resistor 9 and capacitor 10 is about 10 mS. A comparator 11 compares the filtered voltage across capacitor 10 to the reference voltage set by voltage divider 12. When a slip sheet is present, the decrease in capacitance of electrode 3 causes an increased voltage at input of comparator 11, switching the output of the comparator on. This signifies presence of a slip sheet, and inhibits loading of the plate onto exposure device. Obviously, a slip sheet may be also be attached to the side of the plate 4 opposite the polymer. In this case, an electrode 3 is brought into contact with the side of plate 4 opposite the polymer. If a slip sheet 6 is attached to the plate 4, the slip sheet 6 acts as an insulator between plate 4 and electrode 3 and a capacitance is recorded. However, if slip sheet 6 is absent, there is electrical contact between electrode 3 and plate 4 resulting in a very high capacitance reading.

Referring now to FIG. 2-*a*, a slip sheet detector 20, as previously described, is mounted on either side of plate 4. By the way of example the exposure device is an external drum imaging unit. When no slip sheet is detected on either side of plate 4 as it is lowered towards drum 13, by a printing plate loader 17. Should a slip sheet be detected on either side of the plate the loading will be aborted. Plate 4 is lowered until it is stopped by reference edge 15 mounted on drum 13. Reference edge 15 can be a continuous edge or two locating pins and can incorporate a fixed or moveable overhanging edge to secure the front edge of the plate. The preferred method is to use the same edge reference configuration as is going to be used for plate punching and bending. This assures increased accuracy of locating the image relative to the plate cylinder of the press. The registration in the other axis can be provided by a mechanical stop, such as a third pin, or electro-optic edge detection 18. In the latter case the imaging device has an optical edge sensor. When the plate edge interrupts the light beam of the edge sensor the plate location is known. Referring now to FIG. 2-*b*, compression roller 14 is moved forward to compress plate 4 to drum 13, while drum is rotated slowly to wrap plate around the drum. Referring now to FIG. 2-*c*, when roller 14 reaches close to the rear edge of plate 4, a bar containing permanent magnets 16 is lowered to secure the plate edge to drum 13. Drum 13 is made of a ferromagnetic material such as cast iron or has steel inserts to allow magnet 16 to adhere to the drum 13. Since drum 13 rotates to bring the plate edge under magnet 16, any size plate can be clamped. After the magnet 16 is attached to the drum 13, pressure roller 14 (FIG. 2-*d*) is retracted and the drum 13 is free to rotate. To unload plate 4, sequence of operations is reversed. Both compression roller 14 and magnets 16 can be activated by electromagnetic or pneumatic means. In the preferred embodiment the actuation is alone via pneumatic cylinders which are not shown in the drawing as their use is well known.

The combination of double-sided slip sheet detection and loading against a front edge reference, as well as magnetic clamping leads to a very reliable plate loading system.

What is claimed is:

1. An apparatus for automatically detecting if a printing plate is covered by a non-metallic protective slip sheet and for use with a printing plate loading system, comprising:

(i) an electrode operative to form a capacitor plate when in proximity to said printing plate, (ii) a capacitance measuring circuit coupled to said electrode and said printing plate operative to measure capacitance between said electrode and said printing plate, wherein, presence of a slip sheet is indicated by a capacitance reading below a predetermined threshold.

2. A system for automatically loading a printing plate onto an external drum of a printing press while verifying that non-metallic protective slip sheets have been removed from said printing plate, comprising:

a) a capacitance measuring device having (i) an electrode operative to form a capacitor plate when in proximity to said printing plate, and (ii) a capacitance measuring circuit coupled to said electrode and said printing plate operative to measure capacitance between said electrode and said printing plate; and, b) a printing plate loader located proximate to said external drum and operative to load said printing plate onto said external drum when the capacitance measured by said capacitance measuring circuit is greater or equal to a threshold value and to stop loading when the capacitance is less than the threshold value.

3. A system according to claim 2, wherein said external drum has a mechanical stop mounted thereon operative to secure a forward edge of said plate and to align said forward edge to said external drum as said printing plate is advanced towards said external drum.

4. A system according to claim 3, wherein said external drum has a second mechanical stop mounted thereon operative to align a side edge of said printing plate to said external drum as said printing plate is advanced towards said external drum.

5. A system according to claim 3, including an electro-optic detector mounted on said external drum and operative to align a side edge of said printing plate to said external drum as said printing plate is advanced towards said external drum.

6. A system according to claim 2, including at least one compression roller operative to compress said printing plate to said external drum while said external drum is rotated slowly.

7. A system according to claim 2, including a fastening device operative to fasten said printing plate to said external drum once said plate is wrapped around said external drum.

8. A system according to claim 7, wherein said external drum is composed of a ferromagnetic metal and said fastening device has a permanent magnet which is attracted to said external drum so as to hold said printing plate and can be placed at different locations of said external drum to accommodate a variety of sizes of said printing plate.

9. A method of loading onto a printing press a printing plate having a polymer coating over a metallic base, said printing plate selected from a plurality of such plates separated by non-metallic protective slip sheets, comprising:

(a) picking up said printing plate;

(b) bringing an electrode into contact with a face of said plate coated with said polymer;

(c) measuring electrode-to-plate capacitance between said electrode and the face of said plate and comparing the measured electrode-to-plate capacitance with a threshold value of capacitance;

(d) loading said plate onto said printing press if the electrode-to-plate capacitance is greater or equal to the threshold capacitance.

10. A method according to claim 9, including the following steps after said picking up step but before said loading step:

(a) bringing an electrode into contact with a face of said plate opposite a side coated with said polymer;

(b) measuring electrode-to-plate capacitance between said electrode and the face of said plate and comparing the measured electrode-to-plate capacitance with a threshold value of capacitance;

(c) stopping the loading step if the electrode-to-plate capacitance is less than the threshold capacitance.

11. A method according to claim 9, including:

(a) advancing said plate until a forward edge thereof abuts a first mechanical stop mounted on an external drum of said printing press;

(b) compressing said plate to the external drum while the external drum is slowly rotated until said plate is wrapped around the external drum; and (c) fastening a back region of said plate remote from the forward edge which abuts the first mechanical stop.

12. A method according to claim 11, including positioning a side edge of said plate with a second mechanical stop mounted on the external drum.

13. A method according to claim 11, including positioning a side edge of said plate with an electro-optic detector mounted on the external drum.

14. A method according to claim 9, wherein said measuring steps for each face of said plate are done at substantially the same position with respect to said plate.

* * * * *